US007090466B2

(12) United States Patent
Honkomp et al.

(10) Patent No.: US 7,090,466 B2
(45) Date of Patent: Aug. 15, 2006

(54) METHODS AND APPARATUS FOR ASSEMBLING GAS TURBINE ENGINE ROTOR ASSEMBLIES

(75) Inventors: Mark Steven Honkomp, Taylors, SC (US); Joseph Scott Barrett, Greenville, SC (US)

(73) Assignee: General Electric Company, Schenectady, NY (US)

( * ) Notice: Subject to any disclaimer, the term of this patent is extended or adjusted under 35 U.S.C. 154(b) by 59 days.

(21) Appl. No.: 10/940,905

(22) Filed: Sep. 14, 2004

(65) Prior Publication Data

US 2006/0056975 A1 Mar. 16, 2006

(51) Int. Cl.
*F01D 5/16* (2006.01)

(52) U.S. Cl. ..... 416/193 A; 416/239; 29/889.21; 277/637; 277/644

(58) Field of Classification Search ..... 416/193 A, 416/239; 29/889.21; 277/637, 641, 644
See application file for complete search history.

(56) References Cited

U.S. PATENT DOCUMENTS 3,137,478 A * 6/1964 Farrell ..... 416/220 R
4,088,421 A * 5/1978 Hoeft ..... 416/193 A
4,936,749 A * 6/1990 Arrao et al. ..... 416/193 A
5,478,207 A * 12/1995 Stec ..... 416/219 R
6,273,683 B1 8/2001 Zagar et al.
6,478,540 B1 11/2002 Abuaf et al.
6,776,583 B1 * 8/2004 Wang et al. ..... 416/500
6,932,575 B1 * 8/2005 Surace et al. ..... 416/193 A

* cited by examiner

*Primary Examiner*—Edward K. Look
*Assistant Examiner*—Nathan Wiehe
(74) *Attorney, Agent, or Firm*—Armstrong Teasdale LLP

(57) ABSTRACT

A method facilitates assembling a rotor assembly for gas turbine engine. The method comprises providing a first rotor blade that includes an airfoil, a platform, a shank and a dovetail, coupling the first rotor blade to a rotor shaft using the dovetail, and coupling a second rotor blade to the rotor shaft such that a shank cavity is defined between the first and second blades. The method also comprises inserting a seal pin into the horizontal platform seal pin slot such that a gap defined between the first and second rotor blade platforms are substantially sealed wherein the seal pin includes a first end, a second end and a substantially cylindrical body extending therebetween and sized to frictionally engage the slot, wherein at least one of the first and second ends has a cross-sectional area that is smaller than a cross-sectional area of the body.

37 Claims, 5 Drawing Sheets

METHODS AND APPARATUS FOR ASSEMBLING GAS TURBINE ENGINE ROTOR ASSEMBLIES

BACKGROUND OF THE INVENTION

This application relates generally to gas turbine engines and, more particularly, to methods and apparatus for assembling gas turbine engine rotor assemblies.

At least some known rotor assemblies include at least one row of circumferentially-spaced rotor blades, which are known as buckets in some applications. Each rotor blade includes an airfoil that includes a pressure side and a suction side connected together at leading and trailing edges. Each airfoil extends radially outward from a rotor blade platform. Each rotor blade also includes a dovetail that extends radially inward from a shank extending between the platform and the dovetail, and is used to mount the rotor blade within the rotor assembly to a rotor disk or spool. At least some known blades are hollow and include an internal cooling cavity that is defined at least partially by the airfoil, platform, shank, and dovetail.

During operation, a clearance between circumferentially-adjacent blades with a row of blades, may cause a platform seal pin positioned between each blade to bind during initial engine operations and/or during transient operations. Such binding may cause the platform seal pin to deform, may induce cracking within the platform, and/or may cause the seal between the shank area of the blade and the hot gas path to become ineffective. An increase in the sealing effectiveness may increase the life of the blade by facilitating minimizing thermal stresses. Accordingly, within at least some known gas turbine engines, cylindrical pins, machined to mate with a corresponding notch formed in the end cover plates of the blade have been used to facilitate reducing binding of the pins. However, such pins have also been shown to bind in operation.

BRIEF SUMMARY OF THE INVENTION

In one embodiment, a method for assembling a rotor assembly for gas turbine engine is provided. The method comprises providing a first rotor blade that includes an airfoil, a platform, a shank that extends radially inward from the platform and includes a horizontal platform seal pin slot and a dovetail that extends radially inward from the shank, coupling the first rotor blade to a rotor shaft using the dovetail, and coupling a second rotor blade to the rotor shaft such that a shank cavity is defined between the first and second blades. The method also comprises inserting a seal pin into the horizontal platform seal pin slot such that a gap defined between the first and second rotor blade platforms are substantially sealed wherein the seal pin includes a first end, a second end and a substantially cylindrical body extending therebetween and sized to frictionally engage the slot, wherein at least one of the first and second ends has a cross-sectional area that is smaller than a cross-sectional area of the body.

In another embodiment, a gas turbine engine rotor assembly is provided. The rotor assembly includes a rotor shaft, a first blade, a second blade, and a seal pin. The first blade is coupled to the rotor shaft, and includes a first platform and a first shank extending radially inward from the platform. The first shank includes at least one sidewall including a seal pin slot. The second blade includes a second platform and a second shank extending radially inward from the second platform. The second blade is coupled to the rotor shaft adjacent the first blade such that a gap is defined between the first and second platforms, and such that a shank cavity is defined between the first and second shanks. The seal pin is inserted within the seal pin slot, and includes a first end, a second end, and a substantially cylindrical body extending therebetween. At least one of the first end and the second end has a cross-sectional area that is smaller than the body first cross-sectional area.

In a further embodiment, a rotor blade seal pin for a gas turbine engine rotor assembly including a rotor shaft and a plurality of circumferentially-spaced rotor blades coupled to the rotor shaft is provided. Each rotor blade includes a platform and a shank, wherein the shank extends radially inward from the platform. The rotor blade seal pin comprises a first end and a second end, and a substantially cylindrical body having a first cross-sectional area sized for frictional engagement with a rotor blade seal pin slot formed adjacent to the platform. At least one of the first end and the second end has a second cross-sectional area that is smaller than the body first cross-sectional area.

DETAILED DESCRIPTION OF THE INVENTION

Figure 1:
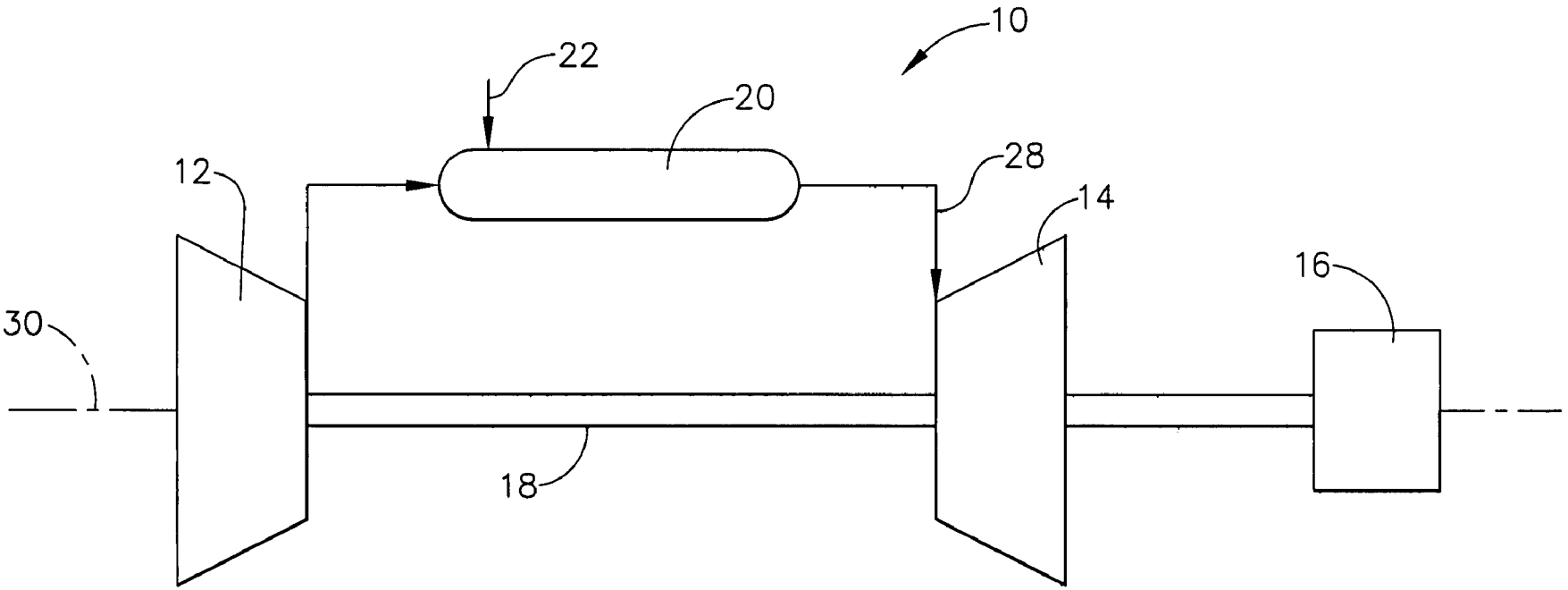
FIG. 1 is schematic illustration of a gas turbine engine.

FIG. 1 is a schematic illustration of an exemplary gas turbine engine 10 coupled to an electric generator 16. In the exemplary embodiment, gas turbine system 10 includes a compressor 12, a turbine 14, and generator 16 coupled via a single rotor or shaft 18. In an alternative embodiment, shaft 18 is segmented into a plurality of shaft segments (not shown), wherein each shaft segment is coupled to an adjacent shaft segment to form shaft 18. Compressor 12 supplies compressed air to a combustor 20 wherein the air is mixed with fuel supplied via a stream 22. In one embodiment, engine 10 is a 7FA+e gas turbine engine commercially available from General Electric Company, Greenville, S.C.

In operation, air flows through compressor 12 and compressed air is supplied to combustor 20. Combustion gases 28 from combustor 20 propels turbines 14. Turbine 14 rotates shaft 18, compressor 12, and electric generator 16 about a longitudinal axis 30.

Figure 2:
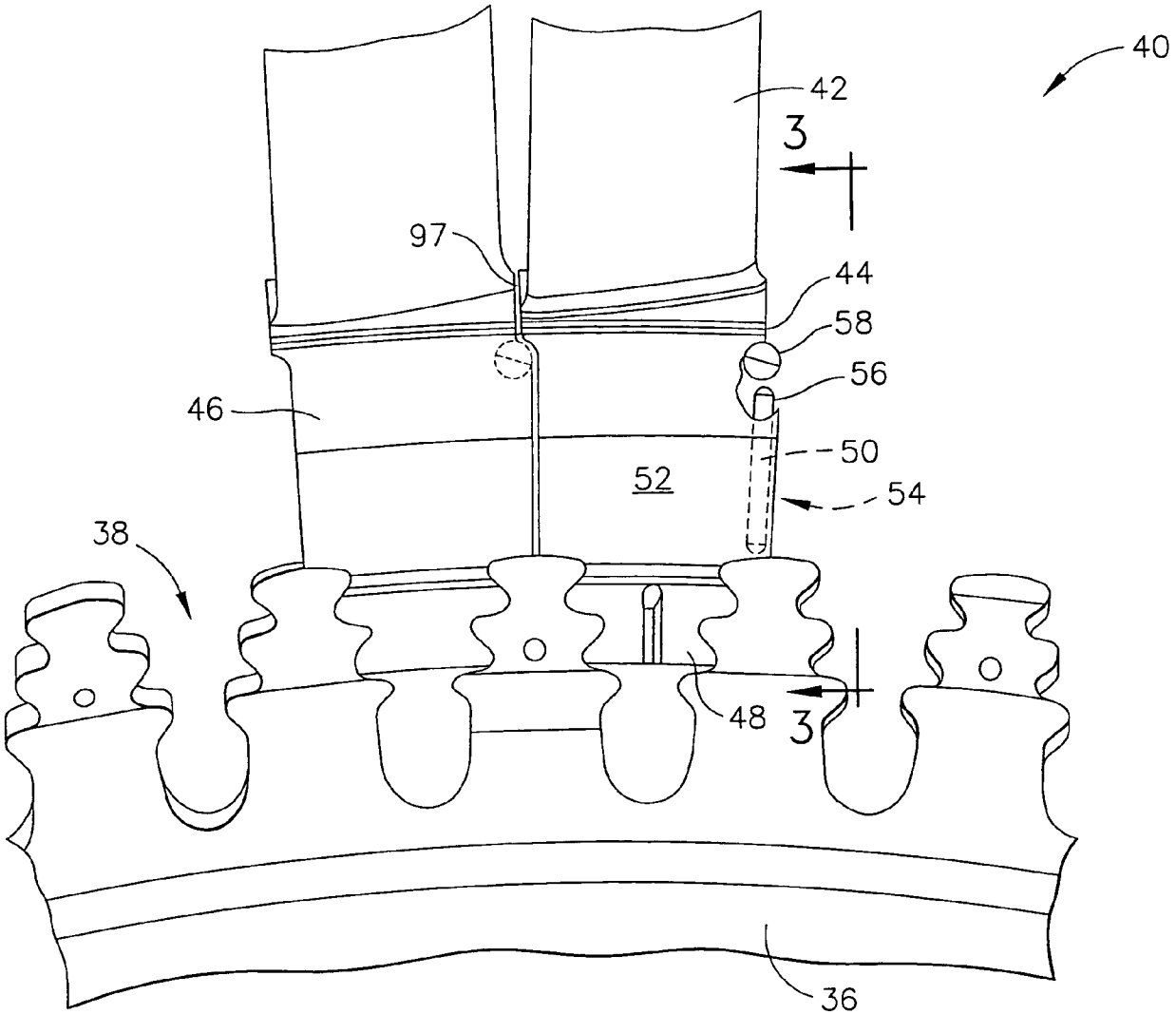
FIG. 2 is a schematic view of a downstream side of an exemplary rotor disk that may be used with the gas turbine engine shown in FIG. 1.

FIG. 2 is a schematic view of a downstream side of an exemplary rotor disk 36 that may be used with gas turbine engine 10 (shown in FIG. 1). Rotor disk 36 includes a plurality of blade slots 38 defined therein and sized to receive a blade 40, as illustrated in two of the plurality of blade slots 38 shown in FIG. 2. In the exemplary embodiment, adjacent blades 40 are substantially identical and each extends radially outward from rotor disk 36 and includes an airfoil 42, a platform 44, a shank 46, and a dovetail 48. In the exemplary embodiment, airfoil 42, platform 44, shank 46, and dovetail 48 are collectively known as a bucket.

Airfoil 42 extends radially outward from platform 44, and shank 46 extends radially inward from platform 44. Shank 46 includes a trailing edge radial seal pin slot 50 that extends generally radially through shank 46 between platform 44 and dovetail 48. More specifically, in the exemplary embodiment, trailing edge radial seal pin slot 50 is defined within a downstream sidewall 52 of shank 46 and is adjacent a convex sidewall 54 of shank 46.

Shank seal pin slot 50 is sized to receive a radial seal pin 56 to facilitate sealing between adjacent rotor blade shanks 46 when adjacent rotor blades 40 are coupled within rotor disk 36. A horizontal platform seal pin 58 is positioned within a horizontal platform seal pin slot (not shown in FIG. 2) to facilitate sealing shank 46 from hot combustion gases 28.

Figure 3:
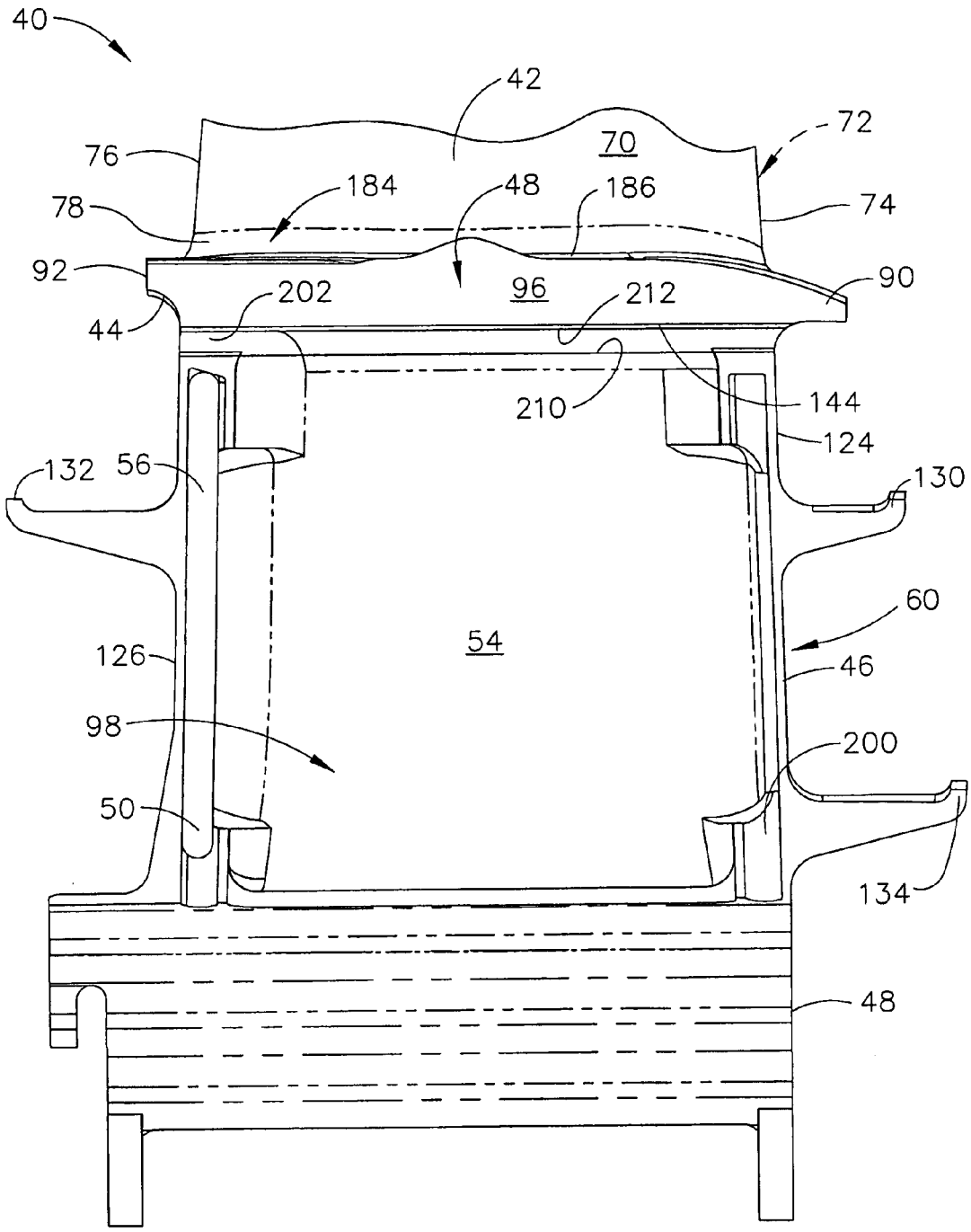
FIG. 3 is an enlarged perspective view of a rotor blade shown in FIG. 1 and viewed from a first side of the rotor blade.

FIG. 3 is an enlarged perspective view of rotor blade 40 viewed from a first side 60 of rotor blade 40. In one embodiment, blade 40 is a newly cast blade 40. In an alternative embodiment, blade 40 is a blade 40 that has been retrofitted to include the features described herein.

When coupled within rotor assembly 10, each rotor blade 40 is coupled to rotor disk 36 and as such, is rotatably coupled to a rotor shaft, such as shaft 18 (shown in FIG. 1). In an alternative embodiment, blades 40 are mounted within a rotor spool (not shown).

Each airfoil 42 includes a first sidewall 70 and a second sidewall 72. First sidewall 70 is convex and defines a suction side of airfoil 42, and second sidewall 72 is concave and defines a pressure side of airfoil 42. Sidewalls 70 and 72 are joined together at a leading edge 74 and at an axially-spaced trailing edge 76 of airfoil 42. More specifically, airfoil trailing edge 76 is spaced chord-wise and downstream from airfoil leading edge 74.

First and second sidewalls 70 and 72, respectively, extend longitudinally or radially outward in span from a blade root 78 positioned adjacent platform 44, to an airfoil tip (not shown). The airfoil tip defines a radially outer boundary of an internal cooling chamber (not shown) that is defined within blades 40. More specifically, the internal cooling chamber is bounded within airfoil 42 between sidewalls 70 and 72, and extends through platform 44 and through shank 46 and at least partially into dovetail 48.

Platform 44 extends between airfoil 42 and shank 46 such that each airfoil 42 extends radially outward from each respective platform 44. Shank 46 extends radially inwardly from platform 44 to dovetail 48, and dovetail 48 extends radially inwardly from shank 46 to facilitate securing rotor blades 40 to rotor disk 36. Platform 44 also includes an upstream side or skirt 90 and a downstream side or skirt 92 which are connected together with a pressure-side edge (not shown) and an opposite suction-side edge 96. When rotor blades 40 are coupled within the rotor assembly, a gap 97 is defined between adjacent rotor blade platforms 44, and accordingly is known as a platform gap.

Shank 46 includes a substantially concave sidewall (not shown) and a substantially convex sidewall 54 connected together at an upstream sidewall 124 and a downstream sidewall 126 of shank 46. Accordingly, the shank concave sidewall is recessed with respect to upstream and downstream sidewalls 124 and 126, respectively, such that when buckets 40 are coupled within the rotor assembly, a shank cavity 98 is defined between adjacent rotor blade shanks 46.

In the exemplary embodiment, a forward angel wing 130 and an aft angel wing 132 each extend outwardly from respective shank sides 124 and 126 to facilitate sealing forward and aft angel wing buffer cavities (not shown) defined within the rotor assembly. In addition, a forward lower angel wing 134 also extends outwardly from shank side 124 to facilitate sealing between buckets 40 and the rotor disk. More specifically, forward lower angel wing 134 extends outwardly from shank 46 between dovetail 48 and forward angel wing 130.

In the exemplary embodiment, a portion 184 of platform 44 is chamfered or tapered along platform suction-side edge 96. In an alternative embodiment, platform 44 does not include chamfered portion 184. More specifically, chamfered portion 184 extends across a platform radially outer surface 186 adjacent to platform downstream skirt 92.

In the exemplary embodiment, shank 46 includes a leading edge radial seal pin slot 200 and a trailing edge radial seal pin slot 50. In an alternative embodiment, shank 46 may include only one, or neither, of slots 200 and 50. Specifically, each seal pin slot 200 and 50 extends generally radially through shank 46 between platform 44 and dovetail 48. More specifically, leading edge radial seal pin slot 200 is defined within shank upstream sidewall 124 adjacent shank convex sidewall 54, and trailing edge radial seal pin slot 50 is defined within shank downstream sidewall 126 adjacent shank convex sidewall 54.

Each shank seal pin slot 200 and 50 is sized to receive a radial seal pin 56 therein to facilitate sealing between adjacent rotor blade shanks 46 when rotor blades 40 are coupled within rotor assembly 10. Although leading edge radial seal pin slot 200 is sized to receive a radial seal pin 56 therein, in the exemplary embodiment, when rotor blades 40 are coupled within the rotor assembly, a seal pin 56 is only positioned within trailing edge seal pin slot 50, and slot 200 remains empty.

Shank 46 also includes a horizontal platform seal pin slot 202 that extends generally axially through shank 46 between shank sides 124 and 126. More specifically, horizontal platform seal pin slot 202 is defined between shank convex sidewall 54 and platform 44 and is substantially parallel to axis 30. Horizontal platform seal pin slot 202 is sized to receive a horizontal platform seal pin 58 therein to facilitate sealing a low pressure side of shank 46 from combustion gases 28. Horizontal platform seal pin slot 202 is defined by a pair of opposed radially-spaced sidewalls 210 and 212, and extends generally axially between shank sides 124 and 126. In the exemplary embodiment, sidewalls 210 and 212 are substantially parallel.

Figure 4:
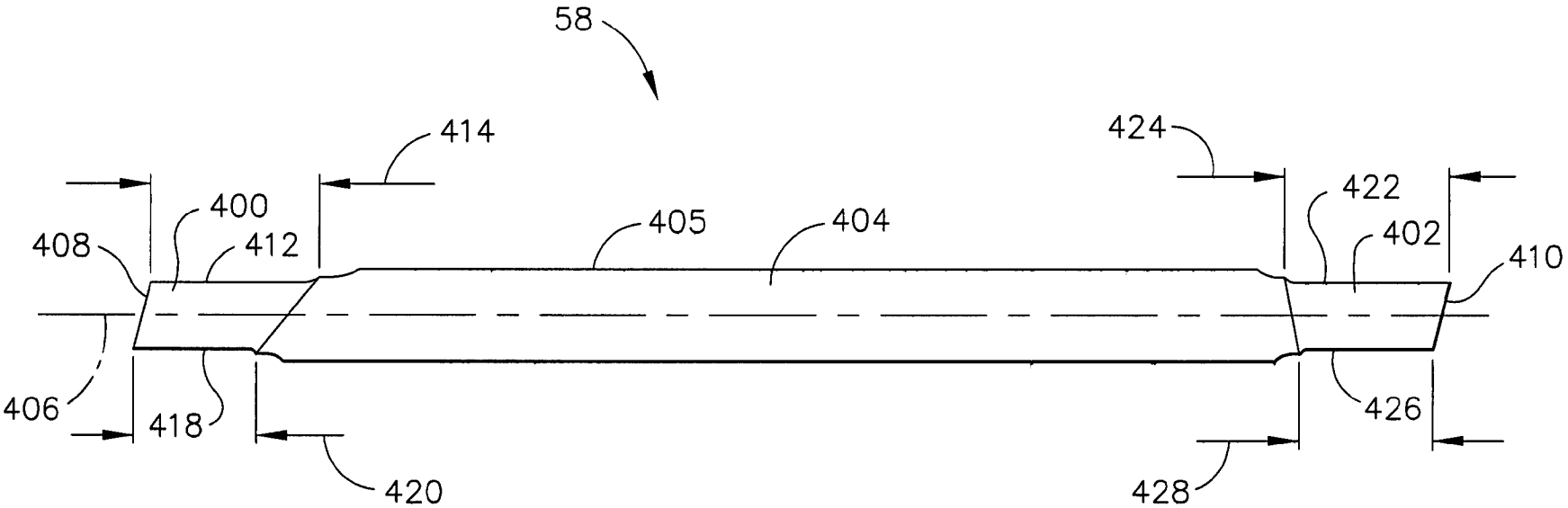
FIG. 4 is an enlarged side schematic view of an exemplary horizontal platform seal pin that may be used with the rotor blade shown in FIG. 3.
Figure 5:
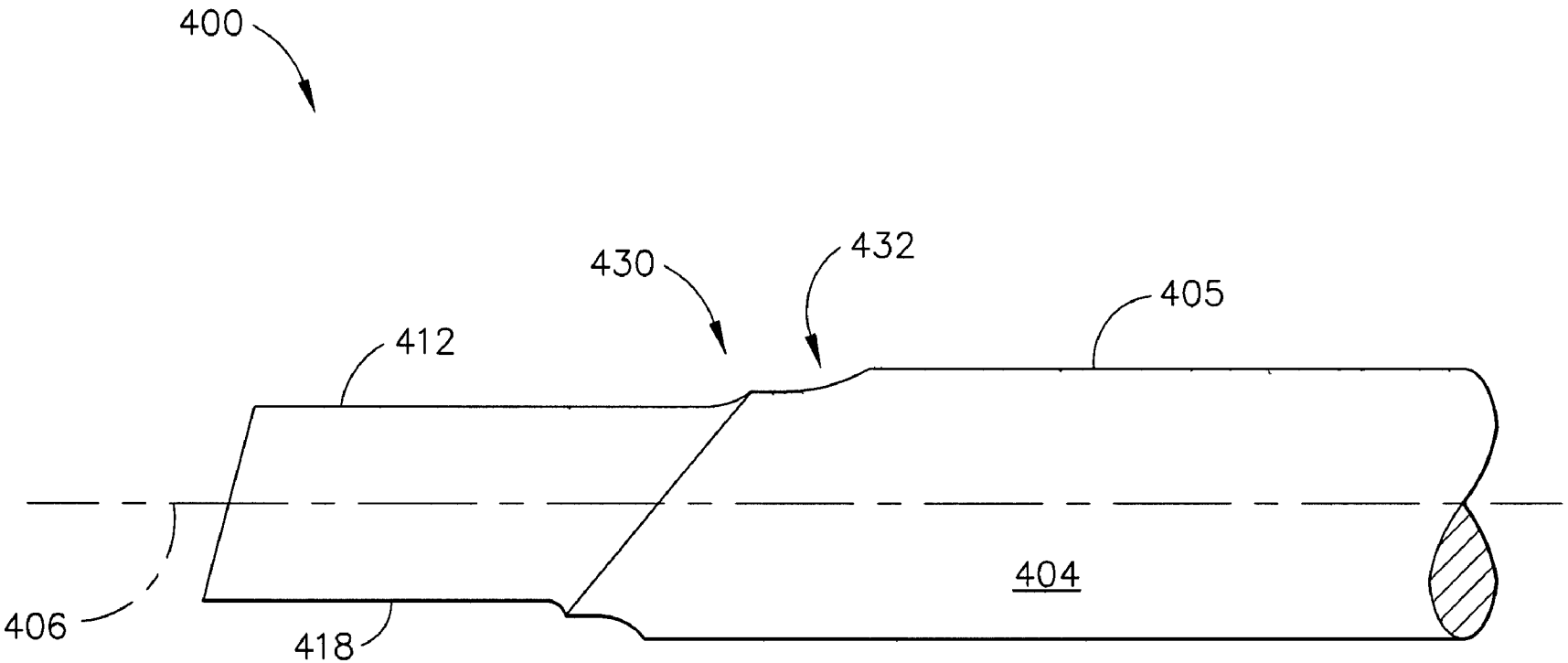
FIG. 5 is an enlarged view of an end of the seal pin shown in FIG. 4.

FIG. 4 is an enlarged side schematic view of an exemplary horizontal platform seal pin 58 that may be used with gas turbine engine 10 (shown in FIG. 1). FIG. 5 is an enlarged view of a first end 400 of pin 58. Horizontal platform seal pin 58 includes end 400, a second end 402, and a substantially cylindrical body 404 extending therebetween. Body 404 has an outer peripheral surface 405 and is generally symmetric about a longitudinal axis 406.

First end 400 includes a first end face 408 and second end 402 includes a second end face 410. In the exemplary embodiment, each end face 408 and 410 is substantially planar and extends obliquely with respect to longitudinal axis 406. In alternative embodiments, at least one of end face 408 and/or 410 is formed substantially perpendicularly to longitudinal axis 406. In another alternative embodiment, at least one of end face 408 and/or 410 is formed non-planarly. In the exemplary embodiment, a first flat 412 extends from first end face 408 generally axially toward second end 402 a first distance 414, such that a substantially planar face is formed by face 408. In an alternative embodiment, a second flat 418, having a substantially planar face, is formed such that the faces of flats 418 and 412 are substantially parallel.

Second flat 418 extends from first end face 408 axially toward second end 402 a second distance 420.

In the exemplary embodiment, a third flat 422 extends from second end face 410 axially toward first end 400 a third distance 424 forming a substantially planar face. In an alternative embodiment, a fourth flat 426, having a substantially planar face, is formed such that the faces of flats 422 and of flat 426 are substantially parallel. Fourth flat 426 extends from second end face 410 axially toward first end 400 a fourth distance 428.

In the exemplary embodiment, a portion of body 404 milled to form flats 412, 418, 422, and 426 is approximately 20 mils. In alternative embodiments, other dimensions may be selected. Flats 412, 418, 422, and 426 are formed and function similarly, and as such, only flat 412 is described below. Referring to FIG. 5, in the exemplary embodiment, each flat 412 includes a radius portion 430 and an adjacent chamfer portion 432. Radius portion 430 is formed by a diameter of the mill tool used to form flat 412, and a chamfer portion 432 is formed to substantially eliminate sharp edges that may result from the milling and/or other machining processes. Radius portion 430 and chamfer portion 432, together form a generally tapered surface extending between flat 412 and an outer peripheral surface 405 of body 404.

During assembly of turbine 14, a horizontal platform seal pin 58 is inserted generally axially into horizontal platform seal pin slot 202 to facilitate sealing a path for combustion gas flow between platforms 92 of each pair of adjacent blades 40 and the shank cavity. During transient operation and engine startup procedures, operating conditions in the path of combustion gases 28 may change relatively rapidly, for example, a temperature of combustion gases may increase or decrease. Such temperature changes cause a temperature gradient across components of blades 40 and rotor disk 36, which causes the components to expand or contract, generally at differing rates than adjacent mating components due to material differences. Expansion or contraction of the components may cause a relative motion between adjacent components, such as for example, blade platforms 44. Horizontal platform seal pin 58 may also move relative to horizontal platform seal pin slot 202 during these temperature transients. During such movement outer peripheral surface 405 slides in frictional engagement with sidewalls 210 and 212. If during the sliding process, horizontal platform seal pin 58 binds in horizontal platform seal pin slot 202, for example, by an edge of horizontal platform seal pin 58 engaging sidewalls 210 and 212 such that the edge digs in or gouges sidewalls 210 and 212, which prevents horizontal platform seal pin 58 from sliding within horizontal platform seal pin slot 202. In such case, horizontal platform seal pin 58 may deform, additional stress may be applied to horizontal platform seal pin slot 202 such that cracks are initiated in the vicinity of horizontal platform seal pin slots 202. In accordance with one embodiment of the present invention, the ability of horizontal platform seal pin 58 to engage sidewalls 210 and 212 in a non-slidable manner is facilitated being reduced by removing portions of body 404 to form flats 412, 418, 422, and 426 and forming an incline surface between outer peripheral surface 405 and flats 412, 418, 422, and 426.

The above-described platform seal pin provides a cost-effective and highly reliable method for sealing a gap between adjacent blade platforms and the shank cavity. More specifically, thermal and mechanical stresses induced within the platform, and the operating temperature of the platform is facilitated to be reduced. Accordingly, platform cracking is also facilitated to be reduced. As a result, the rotor blade horizontal seal pin facilitates extending a useful life of the rotor assembly and improving the operating efficiency of the gas turbine engine in a cost-effective and reliable manner.

Exemplary embodiments of rotor blade seal pins and rotor assemblies are described above in detail. The rotor blade seal pins are not limited to the specific embodiments described herein, but rather, features of each rotor blade seal pin may be utilized independently and separately from other components described herein. For example, each rotor blade seal pin feature can also be used in combination with other rotor blades, and is not limited to practice with only rotor blade 40 as described herein. Rather, the present invention can be implemented and utilized in connection with many other blade and rotor configurations.

While the invention has been described in terms of various specific embodiments, those skilled in the art will recognize that the invention can be practiced with modification within the spirit and scope of the claims.

What is claimed is:

1. A method for assembling a rotor assembly for gas turbine engine, said method comprising:

providing a first rotor blade that includes an airfoil, a platform, a shank that extends radially inward from the platform and includes a horizontal platform seal pin slot and a dovetail that extends radially inward from the shank;

coupling the first rotor blade to a rotor shaft using the dovetail;

coupling a second rotor blade to the rotor shaft such that a shank cavity is defined between the first and second blades; and inserting a seal pin into the horizontal platform seal pin slot such that a gap defined between the first and second rotor blade platforms are substantially sealed wherein the seal pin includes a first end, a second end and a substantially cylindrical body extending therebetween and sized to frictionally engage the slot, at least one of the first and second ends has a cross-sectional area that is smaller than a cross-sectional area of the body, wherein at least one of the first and second ends includes a radius portion that is tapered from an outer peripheral surface of the body and is configured to substantially engage a shank sidewall.

2. A method in accordance with claim 1 wherein providing a first rotor blade comprises providing a first rotor blade that includes a horizontal platform seal pin slot that is formed adjacent the platform and in a radially outward portion of a sidewall of the shank.

3. A method in accordance with claim 1 wherein inserting a seal pin into the horizontal platform seal pin slot comprises inserting the seal pin into the horizontal platform seal pin slot such that the seal pin extends substantially parallel to a longitudinal axis of the rotor.

4. A method in accordance with claim 1 wherein inserting a seal pin into the horizontal platform seal pin slot comprises inserting a seal pin into the horizontal platform seal pin slot wherein at least one of the seal pin first and second ends includes at least one flat.

5. A method in accordance with claim 4 wherein inserting a seal pin into the horizontal platform seal pin slot comprises using a seal pin that includes a chamfer portion, wherein the radius portion and the chamfer portion are tapered between the flat and the outer peripheral surface of the body.

6. A method in accordance with claim 5 wherein inserting a seal pin into the horizontal platform seal pin slot comprises inserting the seal pin into the horizontal platform seal pin slot such that the chamfer portion facilitates enhancing radial pin sealing between adjacent said rotor blades.

7. A method in accordance with claim 5 wherein inserting a seal pin into the horizontal platform seal pin slot comprises using a seal pin wherein at least one of the seal pin first and second ends includes at least one flat.

8. A method in accordance with claim 5 wherein inserting a seal pin into the horizontal platform seal pin slot comprises using a seal pin wherein at least one of the seal pin first and second ends includes at least two flats.

9. A method in accordance with claim 8 wherein inserting a seal pin into the horizontal platform seal pin slot comprises using a seal pin wherein the first flat extends a first distance axially toward the second end and the second flat extends a second distance axially toward the second end, the first distance being different than the second distance.

10. A method in accordance with claim 5 wherein inserting a seal pin into the horizontal platform seal pin slot comprises using a seal pin wherein at least one of the seal pin first and second ends includes at least two flats that are substantially parallel to each other.

11. A method in accordance with claim 5 wherein inserting a seal pin into the horizontal platform seal pin slot comprises using a seal pin wherein the seal pin first and second ends each include a pair of flats.

12. A method in accordance with claim 5 wherein inserting a seal pin into the horizontal platform seal pin slot comprises using a seal pin wherein the seal pin first and second ends each include a pair of flats that are substantially parallel with respect to each other.

13. A gas turbine engine rotor assembly comprising:

a rotor shaft;

a first blade coupled to said rotor shaft, said first blade comprising a first platform and a first shank extending radially inward from said platform, said first shank comprising a sidewall comprising a seal pin slot;

a second blade comprising a second platform and a second shank extending radially inward from said second platform, said second blade coupled to said rotor shaft adjacent said first blade such that a gap is defined between said first and second platforms, and such that a shank cavity is defined between said first and second shanks; and a seal pin inserted within said seal pin slot, said seal pin comprising a first end, a second end, and a substantially cylindrical body extending therebetween, at least one of said first end and said second end has a cross-sectional area that is smaller than a cross-sectional area of said body, wherein at least one of the first and second ends comprises a radius portion that is tapered from an outer peripheral surface of the body and is configured to substantially engage a shank sidewall.

14. A gas turbine engine rotor assembly in accordance with claim 13 wherein said seal pin slot is formed adjacent to said platform and extends substantially parallel to a longitudinal axis of said rotor.

15. A gas turbine engine rotor assembly in accordance with claim 13 wherein at least one of said first end and said second end comprises a flat.

16. A gas turbine engine rotor assembly in accordance with claim 15 wherein said body comprises a chamfer portion, said chamfer portion and said radius are tapered between said flat and said outer peripheral surface of said body.

17. A gas turbine engine rotor assembly in accordance with claim 16 wherein said chamfer portion facilitates sealing circumferentially between said rotor blades.

18. A gas turbine engine rotor assembly in accordance with claim 15 wherein said first end and said second end each comprise a flat.

19. A gas turbine engine rotor assembly in accordance with claim 15 wherein at least one of said first end and said second end comprises at least two flats.

20. A gas turbine engine rotor assembly in accordance with claim 19 wherein at least one of said first end and said second end comprises at least a pair of flats that are substantially parallel to each other.

21. A gas turbine engine rotor assembly in accordance with claim 20 wherein said first flat extends a first distance axially toward said second end, said second flat extends a second distance axially toward said second end, the first distance is different than the second distance.

22. A gas turbine engine rotor assembly in accordance with claim 15 wherein said first end and said second end each comprise at least two flats.

23. A gas turbine engine rotor assembly in accordance with claim 22 wherein said first end and said second end each comprise at least a first flat and a second flat that is substantially parallel to said first flat.

24. A gas turbine engine rotor assembly in accordance with claim 23 wherein said first flat extends a first distance axially toward said second end and said second flat extends a second distance axially toward said second end, the first distance being different than the second distance.

25. A gas turbine engine rotor assembly in accordance with claim 13 wherein said gap defines a fluid flow path, said seal pin substantially seals the fluid flow path defined between said first and second platforms.

26. A rotor blade seal pin for a gas turbine engine rotor assembly including a rotor shaft and a plurality of circumferentially-spaced rotor blades coupled to said rotor shaft, each rotor blade includes a platform and a shank, wherein the shank extends radially inward from the platform, said rotor blade seal pin comprising:

a first end and a second end; and a substantially cylindrical body having a first cross-sectional area sized for frictional engagement with a rotor blade seal pin slot formed adjacent to the platform, at least one of said first end and said second end having a second cross-sectional area that is smaller than said body first cross-sectional area, wherein at least one of the first and second ends includes a radius portion that is tapered from an outer peripheral surface of the body and is configured to substantially engage a shank sidewall.

27. A rotor blade seal pin in accordance with claim 26 wherein at least one of said first end and said second end comprises a flat.

28. A rotor blade seal pin in accordance with claim 27 wherein said body comprises a chamfer portion, said radius portion and said chamfer portion are tapered between said flat and said outer peripheral surface of said body.

29. A rotor blade seal pin in accordance with claim 28 wherein said chamfer portion facilitates sealing between adjacent said rotor blades.

30. A rotor blade seal pin in accordance with claim 27 wherein said first end and said second end comprises a flat.

31. A rotor blade seal pin in accordance with claim 30 wherein said first end and said second end each comprise at least two flats.

32. A rotor blade seal pin in accordance with claim 31 wherein said first end and said second end each comprise at least at least a pair of flats that are substantially parallel to each other.

33. A rotor blade seal pin in accordance with claim 32 wherein said first flat extends a first distance axially toward said second end and said second flat extends a second distance axially toward said second end, the first distance being different than the second distance.

34. A rotor blade seal pin in accordance with claim 27 wherein at least one of said first end and said second end comprises at least two flats.

35. A rotor blade seal pin in accordance with claim 34 wherein at least one of said first end and said second end comprises at least a first flat and a second flat that is substantially parallel to said first flat.

36. A rotor blade seal pin in accordance with claim 35 wherein said first flat extends a first distance axially toward said second end and said second flat extends a second distance axially toward said second end, the first distance being different than the second distance.

37. A rotor blade seal pin in accordance with claim 26 wherein said rotor blade seal pin substantially seals a fluid flow path defined between adjacent platforms and a shank cavity defined between adjacent rotor blades.

* * * * *